United States Patent [19]

Ende

[11] Patent Number: 4,726,293

[45] Date of Patent: Feb. 23, 1988

[54] WRINKLE-PREVENTING PASSIVE ROLLER SYSTEM FOR PRINTING MACHINES

[75] Inventor: Don S. Ende, Commack, N.Y.

[73] Assignee: Miltope Business Products, Inc., Melville, N.Y.

[21] Appl. No.: 20,594

[22] Filed: Mar. 2, 1987

[51] Int. Cl.[4] ..... B65H 23/14; B65H 9/00

[52] U.S. Cl. ..... 101/228; 26/99; 38/52; 101/246; 101/409; 226/38; 226/162; 271/251

[58] Field of Search ..... 26/99; 101/216, 420, 101/228, 246, 409, 407 A; 271/251, 277; 226/134, 24, 158, 27, 162, 140, 32, 41, 38; 38/52, 44, 46

[56] References Cited

U.S. PATENT DOCUMENTS

| | | | |
|---|---|---|---|
| 1,385,654 | 7/1921 | Bacon | 271/251 |
| 2,152,561 | 3/1939 | Nigra | 101/407 A |
| 2,672,090 | 3/1954 | Dell | 101/409 |
| 2,767,790 | 10/1956 | Jacobson | 101/407 A |
| 3,440,955 | 4/1969 | Howard | 226/162 |
| 3,496,864 | 2/1970 | Tonkin | 101/409 |
| 3,612,513 | 10/1971 | Godlewski | 271/251 |
| 3,828,672 | 8/1974 | Gozzola | 271/277 |
| 4,395,032 | 7/1983 | Hipp | 271/251 |
| 4,419,003 | 12/1983 | Fujie | 226/24 |

FOREIGN PATENT DOCUMENTS

| | | | |
|---|---|---|---|
| 499585 | 6/1930 | Fed. Rep. of Germany | 38/52 |
| 1143210 | 2/1963 | Fed. Rep. of Germany | 101/216 |
| 3500986 | 7/1986 | Fed. Rep. of Germany | 271/251 |
| 59-138 | 4/1983 | Japan | 271/251 |
| 276972 | 7/1970 | U.S.S.R. | 101/228 |

*Primary Examiner*—Lyde I. Coughenour

*Attorney, Agent, or Firm*—Gottlieb, Rackman & Reisman

[57] ABSTRACT

A wrinkle-preventing mechanism for a high-speed printer, in which the web constituting the printing medium passes between skewed image and pressure cylinders while being subjected thereby to a high pressure, includes a flat-surfaced, rigid pressure pad underlying the web path toward the nip of the cylinders, a skewed, freely rotatable, elastomer-surfaced drag-inducing roller for pressing the web over its entire width against the pressure pad, and a loading system for applying forces to the roller to provide the requisite loading across the entire width of the web. A skew angle for the drag-inducing roller of about 2°–5° relative to the perpendicular to the direction of movement of the web toward the nip is preferred.

15 Claims, 6 Drawing Figures

WRINKLE-PREVENTING PASSIVE ROLLER SYSTEM FOR PRINTING MACHINES

TECHNICAL FIELD

This invention relates generally to high-speed printers utilizing fanfolded or continuous web media (paper, film, etc.) and suitable for use with various type of business and data processing machines, and more particularly to an anti-wrinkle system for use with such a printer, for example, one operating on the ion deposition imaging principle.

BACKGROUND ART

High speed printers, including those of the ion deposition imaging type, are per se well known. In a commercially available ion deposition imaging type of printer, for example, the operative mechanism includes a pair of cylindrical rollers in surface contact with each other and defining a nip therebetween through which the web to be printed on is drawn by the rollers as they rotate. Generally, the upper and larger one of these rollers, which is called the image drum or cylinder, is the one to which the appropriate ion-generated charges and the toner are applied, while the lower and smaller roller, which is called the pressure cylinder, is the one which causes the toner and the paper web passing between the two to be subjected to a high pressure, on the order of 1,000 psi or more, for cold fusion transfixing the toner from the image cylinder to the paper. The image cylinder in this system has its axis oriented perpendicularly to the direction of travel of the paper web, while the pressure cylinder is skewed to the image cylinder and has its axis oriented obliquely to the image cylinder axis and thus also to the direction of travel of the web, with the two axes intersecting each other substantially at the mid-points of the two cylinders.

While the cold fusion transfixing process is highly effective, resulting in the transfer of substantially 100% of the toner image from the image cylinder to the paper, experience has shown that the skewed arrangement of the two cylinders tends to generate speed differentials and temporary longitudinal elongations in the web at various points across the width of the latter. Also, as the web is fed through the nip of the cylinders, i.e., the spiral contact area between the image cylinder and the pressure cylinder, the speed differential across the web generates transverse web stresses along lines oriented obliquely to the direction of travel of the web. This results in the creation of ridges or "soft" wrinkles in the portion of the body of the web just upstream of and approaching the nip, as well as a degree of bagginess at the outer extremities of the various stress areas in the regions of the opposite side edges of the web. Since these "soft" wrinkles and baggy edges increase and accumulate as the web enters the nip, they are then effectively ironed into the web as permanent creases or "hard" wrinkles.

DISCLOSURE OF THE INVENTION

It is an object of the present invention to provide, for use in combination with high speed printers, e.g. a printer of the ion deposition imaging type having skewed image and pressure cylinders, a passive mechanism for inhibiting the formation of "soft" wrinkles and baggy edges in the web just prior to its being drawn into the nip of the cylinders and for thereby preventing any undesirable creasing or "hard" wrinkling of the web as it passes between the cylinders.

It is also an object of the present invention to provide a mechanism of the aforesaid type which is relatively simple and inexpensive to manufacture and maintain in comparison with prior mechanisms designed for similar purposes.

Generally speaking, the objectives of the present invention are achieved by providing, in combination with a high speed printer as aforesaid, a mechanism for preventing wrinkling and creasing of the web, which mechanism comprises a rigid member extending transversely to the path of movement of the web toward the nip, the rigid member being located upstream of and close to the nip and providing across the expanse thereof a first surface of an appropriate coefficient of friction and adapted to be contacted by one of the surfaces of the web moving toward the nip. The mechanism further includes a rigid cylindrical roller which is juxtaposed to the rigid member, so that the path of movement of the web passes between the roller and the rigid member, and provides over its periphery a second surface of elastomeric material adapted to contact the other surface of the web. The axis of rotation of the roller is oriented obliquely to the direction of movement of the web toward the nip, and suitable biasing means are provided for urging the roller toward the rigid member. The arrangement is such that when the roller is pressed by the biasing means against the moving web and the rigid member, the biasing force on the one hand is sufficiently low as not to interfere with the ability of the web to slide over the said first surface on the rigid member while the roller is entrained into rotation by the passing web, and on the other hand is sufficiently high as to enable the first surface on the rigid member to exert a frictional drag on the web. Preferably, the said first surface on the rigid member is a flat metallic surface constituted by the member itself, while the elastomeric second surface on the roller is constituted by a sleeve of, for example, polyurethane fitted onto a cylindrical metallic core.

In a particular embodiment of the wrinkle-preventing mechanism of the present invention, the rigid member and the roller are mounted on respective frames straddling the path of movement of the web toward the nip. Of these frames, one is stationary and includes a rigid horizontal crossbar extending perpendicularly to the direction of movement of the web above the path thereof, and a pair of rigid downwardly depending vertical side bars between the lower end regions of which the rigid member is fixedly supported so as to dispose it below the path of movement of the web. The other frame is movable and includes a pair of spaced, rigidly interconnected rigid side arms which are supported intermediate their upper and lower ends by a horizontal mounting plate for pivotal rocking movement about a horizontal axis located above the web path and parallel to the axis of rotation of the roller which itself is journaled in the lower end regions of the said side arms, the mounting plate in turn being pivotally supported by the first frame for angular movement relative thereto about a vertical axis. The biasing means is interconnected between the two frames and preferably is constituted by a pair of tension springs located at opposite sides of the aforesaid vertical axis, each spring being anchored at one end to a tie rod extending between the upper regions of the side arms of the second frame and at its other end to a respective adjunct of the crossbar of the first frame. Thus, with the tie rod being located on the side of the horizontal rocking axis of the side arms remote from the side where the roller is located, the springs tend to rock the second frame about that axis so as to urge the roller toward the flat surface on the rigid member.

It will be understood from the foregoing that the orientation of the second frame relative to the first frame is determined by the joint angular displacement of the mounting plate and the second frame about the vertical axis, which in turn determines the obliquity of the axis of rotation of the roller relative to the direction of movement of the web. To enable this orientation to be properly set, the frames are provided with adjustable stop or abutment means therebetween. In the currently preferred form of the mechanism of the present invention, the abutment means comprises a pair of horizontal screws or bolts threadedly supported by respective vertical lugs carried by the mounting plate for the second frame at opposite sides of the vertical pivot axis thereof, each screw or bolt having its tip located at one side of the associated lug and bearing against the horizontal crossbar of the first frame, and each such screw further carrying a lock nut at the other side of the associated lug. The angular orientation of the second frame relative to the first frame thus can be selected and fixed by the different degrees to which the tips of the screws are spaced from their respective lugs.

It will further be understood that the rockability of the second frame about the horizontal axis provided by the mounting plate serves to enable the roller to be separated temporarily from the flat surface of the rigid member carried by the first frame so as to permit the web to be threaded through the resultant gap toward the nip, for example, at the start of a printing run. To ensure that this may be done by the operator in complete safety and while using both hands, a normally inactive latching means is provided for releasably locking the second frame to the first frame once the former has been shifted against the force of the biasing springs to a position separating the roller from the flat surface. In the currently preferred form of the mechanism according to the present invention, the latching means includes a bar-shaped hook member which is pivotally supported by the crossbar of the stationary first frame for angular movement in a vertical plane and has a hook-forming downwardly open recess in the underside edge of the bar. The hook member is long enough so that normally, i.e., when the roller is pressed against the rigid member on the first frame, it rests loosely and in a disengaged state on the aforesaid tie rod between the two side arms of the second frame. At the same time, the recess is shaped and dimensioned to easily receive and accommodate the tie rod and is located on the bar so as to come to overlie, and hence to enable the hook-forming portion of the bar to drop onto, the tie rod when the second frame has been rockably shifted sufficiently to create the desired gap between the roller and the rigid member. The second frame will then remain locked in that position so as to maintain the gap until the hook member is manually released from the tie rod.

In normal use, the oblique orientation of the axis of rotation of the roller relative to the direction of movement of the web toward the nip will generally correspond to the oblique orientation of the axis of rotation of the pressure cylinder relative to that direction. Although the particular angle at which the roller axis will be oriented may differ from that of the pressure cylinder axis, it will basically depend on a number of factors, including primarily the skew angle of the pressure cylinder and the nature of the paper or web, and especially on such properties thereof as its thickness, tensile strength, etc. In general, it is contemplated that in most cases the angle will be between about 2° and about 5° relative to the perpendicular to the direction of movement of the web. Further, as previously stated, the biasing force applied to the roller will be such as to enable the flat surface on the rigid member to exert a frictional drag on the web while permitting it to slide over the surface as the web is simultaneously entraining the roller into rotation. Here too it will be understood that the nature of the web and the tensile forces to be applied to the web will determine the precise pressure to be exerted by the roller on the web, but it is contemplated that, by way of example, for an average computer paper having a basis weight of approximately 18 pounds on the average, the force exerted by the roller on the web will be approximately 8 pounds. It has been found, in this regard, that the skew angle of the roller and the force it exerts on the web can be held constant for a wide range (15–30 lbs.) of web basis weights.

Through the use of the mechanism according to the present invention, it is found that the tendency of the web to buckle or form "soft" wrinkles as it approaches the skewed image and pressure cylinders of the printer is effectively eliminated, as are the tendencies of the web to form baggy edges. Thus, the mechanism serves to create a back tension across the full width of the web a short distance upstream of the nip by having the passive roller apply a normal force to the web which is then frictionally coupled to the underlying rigid surface. It will be understood by those skilled in the art that it is the frictional drag exerted on the web by that surface which provides the requisite back tension to stress the web uniformly. Moreover, since the roller is skewed at a small angle relative to the perpendicular to the direction of travel of the web, a transverse relative velocity component between the web and the roller is generated which tends to spread the web and remove bagginess and "soft" wrinkles therefrom.

BRIEF DESCRIPTION OF THE DRAWINGS

The foregoing and other objects, characteristics and advantages of the present invention will be more clearly understood from the following detailed description of a preferred embodiment thereof when read in conjunction with the accompanying drawings, in which.

DETAILED DESCRIPTION

Figure 1:
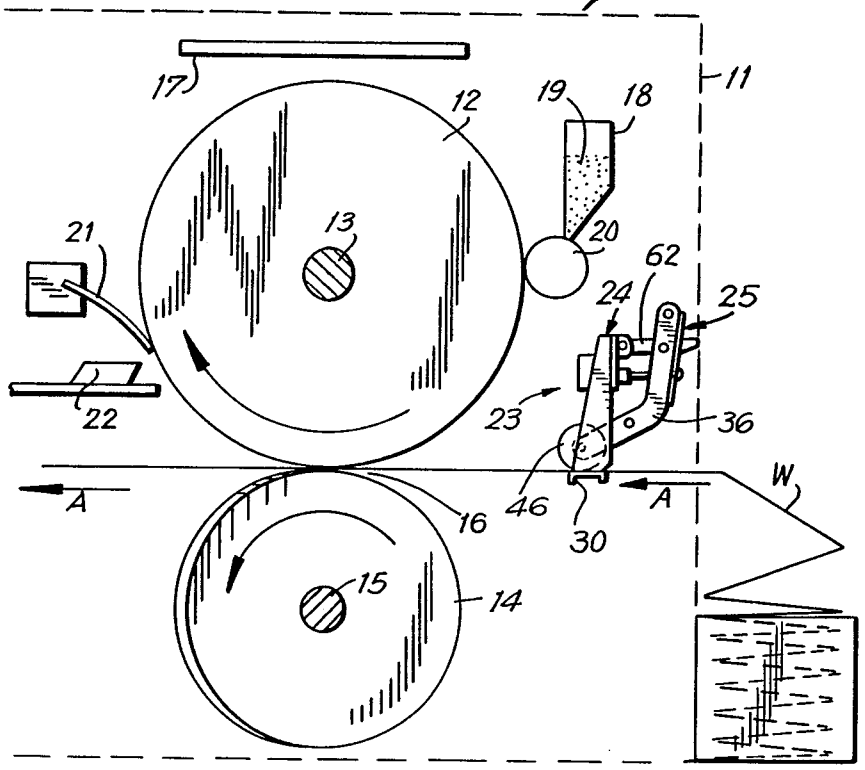
FIG. 1 is a schematic, fragmentary, side elevational view of a high speed printer and diagrammatically illustrates the arrangement of the wrinkle-preventing mechanism according to the present invention relative to the image and pressure cylinders of the printer.
Figure 2:
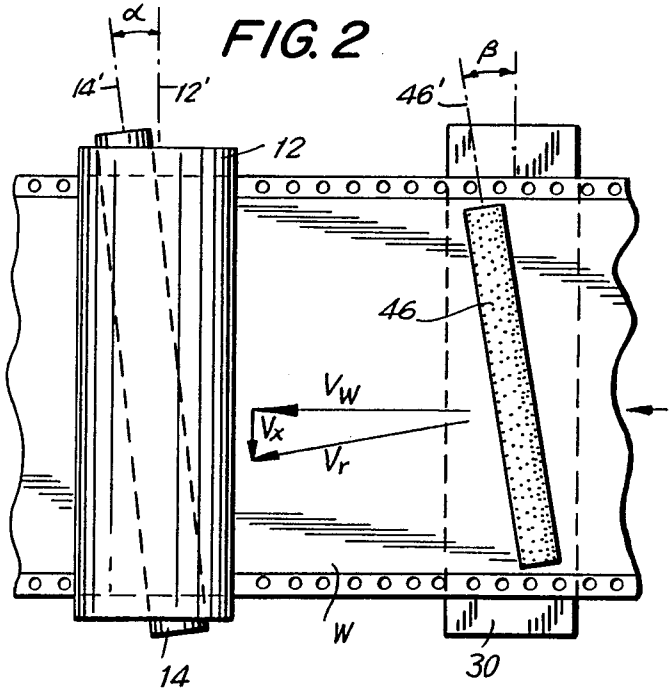
FIG. 2 is a schematic illustration of the oblique orientations of the pressure cylinder of the printer and of the drag-inducing roller of the wrinkle-preventing mechanism relative to the direction of movement of the web.

Referring now to the drawings in greater detail, there is shown in FIG. 1 a diagrammatic representation of, by way of example, a high speed printer 10 of the ion deposition imaging type. The printer has a housing 11 (indicated in broken lines only) in which are located an upper, relatively larger roller 12 journaled for rotation on an axle 13 and a lower, relatively smaller roller 14 journaled for rotation on an axle 15. The rollers, of which the roller 12 constitutes the image cylinder and the roller 14 the pressure cylinder, are in rolling contact with each other under a high pressure (generally on the order of about 1,000 lbs. or more) provided by the pressure cylinder 14, and define a nip 16 therebetween through which the web W to be printed on passes in the direction of the arrows A. As best shown in FIG. 2, the pressure cylinder 14 is skewed relative to the image cylinder 12, with the axis of rotation 12' of the image cylinder being perpendicular to the direction of movement of the web W and with the axis of rotation 14' of the pressure cylinder being oriented at an angle $\alpha$ to the axis of rotation of the image cylinder.

The web W can, of course, be of any suitable type. Merely by way of example, the web W is shown in FIG. 1 as being a fanfolded edge-perforated computer paper drawn from a source stack or package thereof located outside the housing 11, but the web could just as well be continuous and drawn from a roll. As usual in such printers, there are provided in the housing 11 an ion cartridge or generator 17 to apply the desired charge pattern to the image cylinder 12, a hopper 18 containing the toner 19 to be applied to the charged regions of the image cylinder, a magnetized roller 20 for transferring the toner from the hopper 18 to the surface of the image cylinder 12, a scraper 21 for removing any residual quantities of toner from the surface of the image cylinder left thereon after the major portion of the toner has been transfixed by cold fusion to the web, a receptacle 22 for receiving the scraped off toner, and an electrostatic charge erase device (not shown) for removing any residual charge from the image cylinder. Also present in the housing are such conventional components as a drive motor, a power supply, a humidity control device, and the like, which it is not necessary to show.

Figure 3:
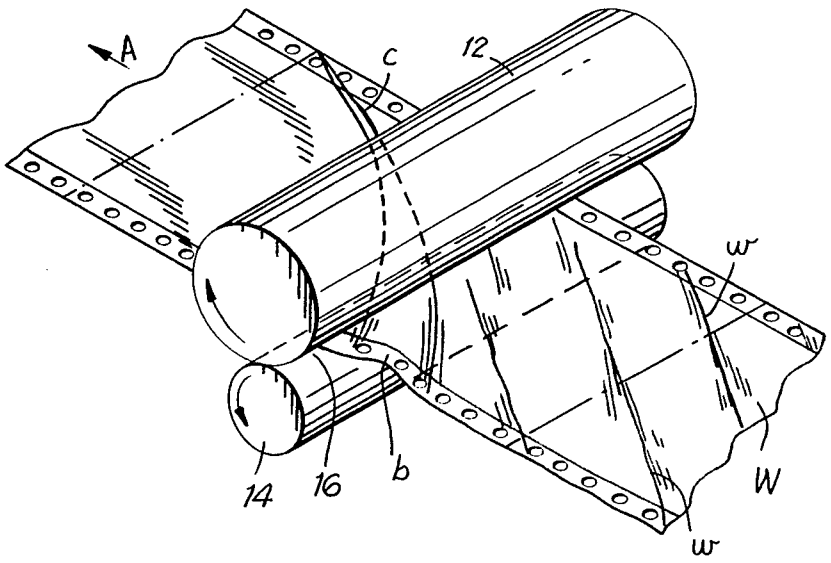
FIG. 3 is a diagrammatic representation of "soft" wrinkles and baggy edges such as may be formed in a web as it approaches the nip of the image and pressure cylinders in the absence of the wrinkle-preventing mechanism according to the present invention.

FIG. 3 diagrammatically illustrates some effects which the skewed arrangement of the image and pressure cylinders may have on the web W traveling therebetween in the direction of the arrow A. In such an arrangement, there is a tendency in the web to form "soft" wrinkles w generally extending along oblique stress lines developed in the web, which, as the web enters the nip 16, result in the formation of bulges or baggy edges b in the side region of the web. With the pressure between the cylinders 12 and 14 ordinarily being as high as about 1,000 lbs. or even more, the "soft" winkles and baggy edges end up effectively being ironed into the web W so as to form hard wrinkles or creases c. This will not only disfigure and distort the web as a whole so as to interfere with the legibility of the intelligence printed on the web, but it will also lead to distortions of the sprocket hole-providing edge strips of the web so as to interfere with subsequent refolding and stacking of the web.

Figure 4:
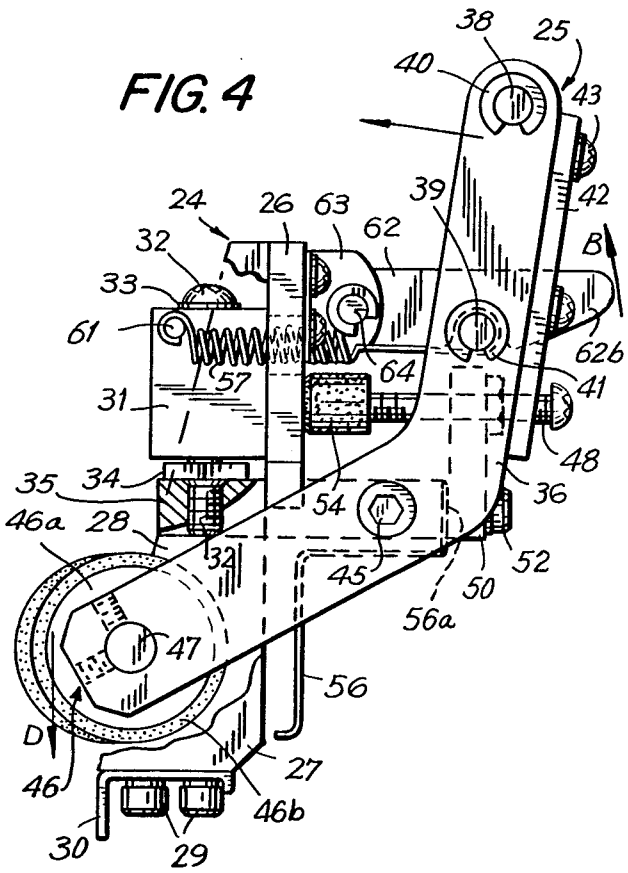
FIG. 4 is an enlarged side elevational view of the wrinkle-preventing mechanism shown in FIG. 1 and illustrates the roller separated from the friction surface on the stationary frame and the roller-supporting rockable frame in its shifted and latched condition.
Figure 5:
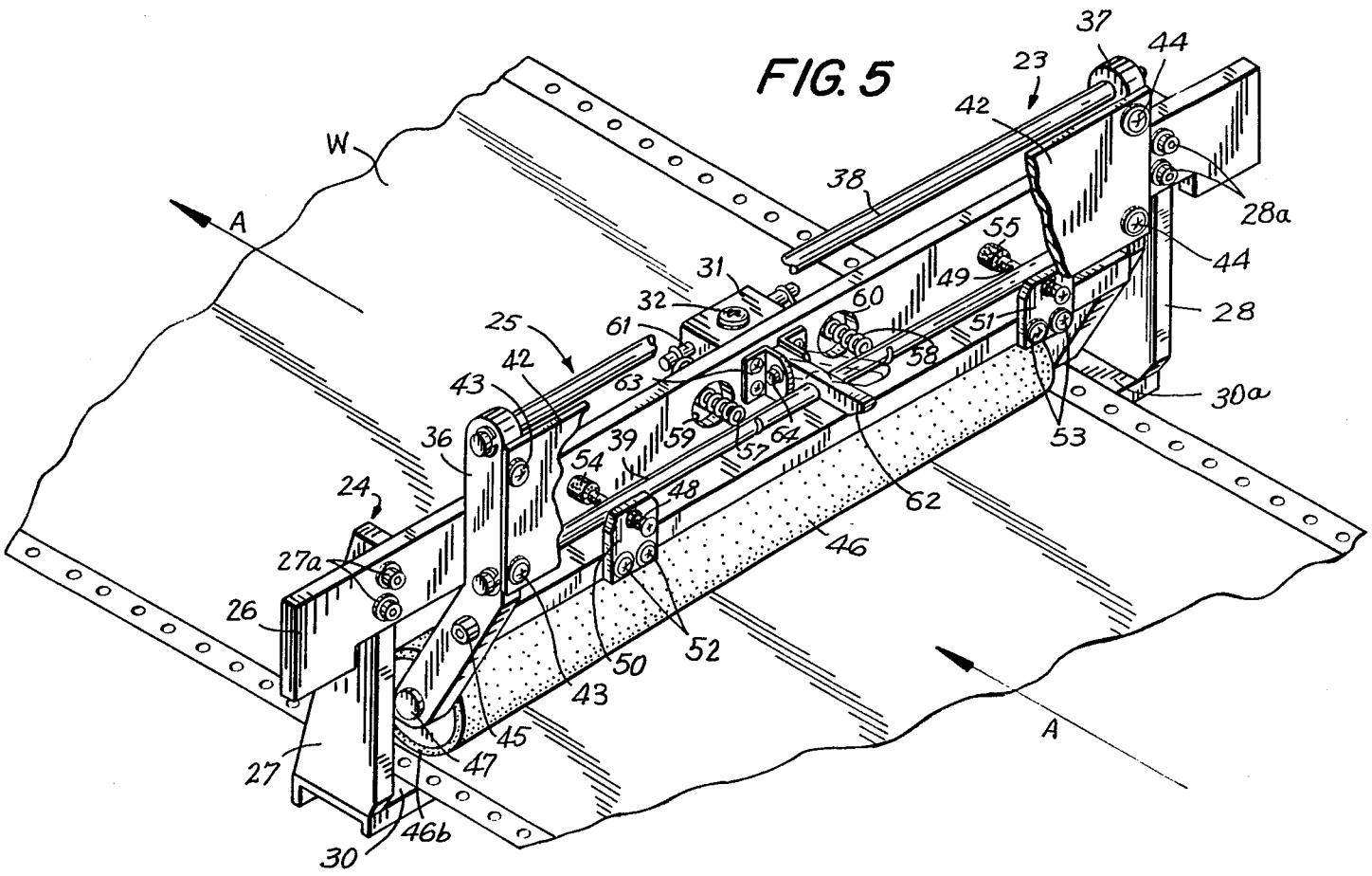
FIG. 5 is a perspective illustration of the wrinkle-preventing mechanism in the state thereof shown in FIG. 4, with parts being broken away to show interior details.
Figure 6:
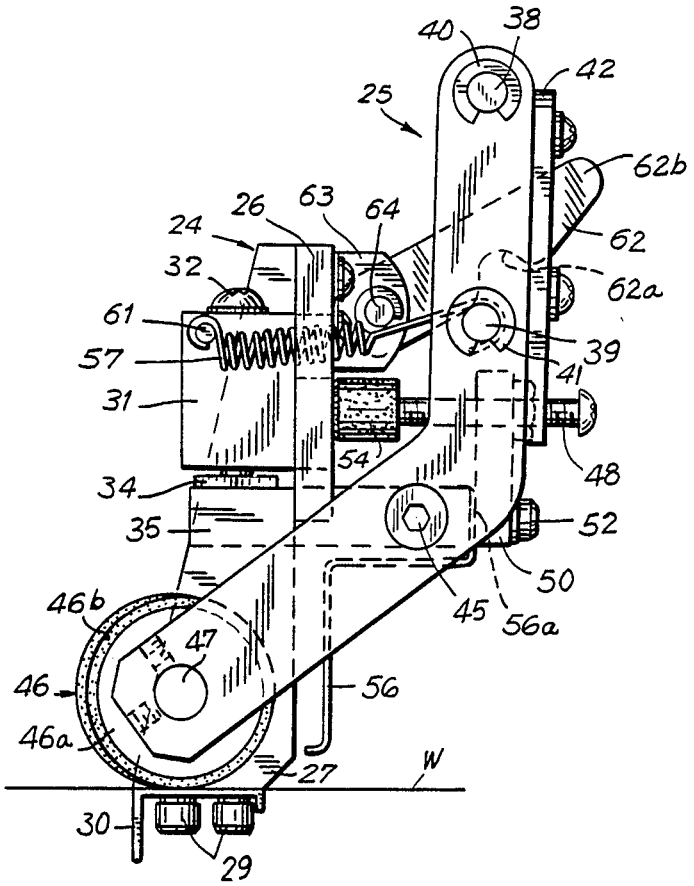
FIG. 6 is a view similar to FIG. 4 but illustrates the roller-supporting frame in its unlatched condition and rocked to a position in which the roller presses the web against the friction surface.

In order to minimize the risk of these possible drawbacks, the wrinkle-preventing mechanism 23 according to the present invention is located upstream of the nip 16 within the housing 11 of the printer and relatively close to the nip. As best shown in FIGS. 4, 5 and 6, the mechanism 23 comprises a stationary frame 24 and a movable frame 25 both straddling the path of travel of the web W. The stationary frame 24 is fixedly mounted in the housing 11 in a manner not explicitly illustrated, for example, by being bolted in place, and includes an upper rigid crossbar or cross member 26 to which, adjacent its opposite ends, a pair of downwardly depending vertical bars 27 and 28 are secured by bolts or screws *27a*, *28a*. Affixed to the lower ends of the vertical bars 27 and 28 by screws or bolts 29 is a rigid horizontal member 30 having an upper flat surface *30a* which closely underlies the path of travel of the web W and the effective width of which, corresponding essentially to the distance between the bars 27 and 28, is somewhat greater than the width of the web. In the illustrated embodiment, the member 30 is a generally channel-shaped beam-like structure (the side flanges thereof providing the requisite resistance to flexure) made entirely of metal, e.g., steel, but its web-contacting surface need not be metallic but could be constituted of any material providing the proper coefficient of friction and wear resistance.

Fixedly secured to the crossbar 26 of the stationary frame 24 is a bearing block 31 which houses a central vertical sleeve bearing. Extending through the bearing is the shank of a shoulder screw or bolt 32, the head of which is disposed atop the bearing block 31 but is yieldingly spaced therefrom by an arrangement of washers 33 (indicated only generally but including a flat washer, a lock washer and a curved spring washer). At its tip end region, the shank of the bolt 32 projects out of the bottom of the bearing block and with the aid of a lock nut 34 is screwed tightly into a central internally threaded bore of a rigid horizontal plate 35 which, as more fully described hereinafter, is a mounting plate for the movable frame 25. The mounting plate 35 thus is pivotally supported by the stationary frame 24 for angular movement in opposite senses in a horizontal plane about the vertical axis defined by the screw or bolt 32.

The movable frame 25 comprises a pair of angled side arms 36 and 37 the upper regions of which are rigidly interconnected with each other by a pair of tie rods 38 and 39 locked to the respective arms with the aid of associated lock washers 40 and 41 and by a stiffening plate 42 connected at its opposite ends to the respective side arms with the aid of screws or bolts 43 and 44. The frame 25 is pivotally supported by the mounting plate 35 at the opposite ends of the latter, through the intermediary of a pair of horizontally aligned pivot bolts 45 (only one is shown) extending through the side arms 36 and 37 into the plate 35, for rocking movement about a horizontal axis. A cylindrical roller 46 is freely rotatably supported by the side arms 36 and 37 at the lower end regions of the latter for rotation about a horizontal axis parallel to the rocking axis of the frame 25. For the purposes of the present invention, the roller 46 is shown as being composed (see FIGS. 4, 5 and 6) of a rigid cylindrical core *46a*, e.g. a tube, preferably metallic, and a cylindrical outer sleeve *46b* of elastomeric material, preferably polyurethane, with the core having a pair of bearings at its opposite ends and through the intermediary thereof being rotatably supported by a stationary shaft 47 fixed at its opposite ends to the side arms 36 and 37. The entire arrangement is such that the roller 46 is juxtaposed to the rigid member 30, with the peripheral surface of the roller being located closely above the path of travel of the web W.

As previously mentioned, it is a feature of the present invention that the roller 46 is skewed to the direction of movement of the web W in generally the same sense as the pressure cylinder 14 of the printer, i.e., in the operational state of the roller its axis of rotation 46' is oriented at a small angle $\beta$ (see FIG. 2) to the perpendicular to the direction of movement of the web. The tangential velocity $V_r$ of the roller can be resolved into a velocity component $V_w$ which is equal to the web velocity and a velocity component $V_x$ transverse to the direction of movement of the web. It is this transverse component which, as previously mentioned, tends to spread the web and remove the "soft" wrinkles and baggy edges therefrom. In this regard it will be understood that the elastomeric sleeve or coating **46*b* on the roller core 46*a*** serves to enable a relatively uniform contact pressure to be achieved between the roller and the web over the entire width thereof, and further serves to provide the frictional coupling of the transverse velocity component $V_x$ to the web needed to achieve the desired spreading action.

The achievement of this result makes it essential, of course, that any given preselected orientation of the roller 46 be firmly maintained during a printing run. To this end, adjustable abutment means are provided for fixing the movable frame 25 in the appropriate relationship to the stationary frame 24. In the illustrated form of the wrinkle-preventing mechanism according to the present invention, the adjustable abutment means comprise a pair of screws or bolts 48 and 49 which are threadedly supported by respective lugs or brackets 50 and 51 affixed by means of screws 52 and 53 to the mounting plate 35. Each of the screws or bolts 48 and 49 has the tip end region of its shank located to the side of the respective lug or bracket 50 and 51 facing the crossbar 26 of the stationary frame and carries a lock nut between the head of that screw or bolt and the face of the respective lug or bracket 50 and 51 directed away from the crossbar 26. To minimize wear and tear, the screws or bolts 48 and 49 are provided with respective rubber or plastic tip covers 54 and 55.

It will be understood, therefore, that in order to dispose the roller 46 at any given oblique orientation relative to the direction of movement of the web, the screws or bolts 48 and 49, with their respective lock nuts loosened, are rotated in one sense or the other so as to position the tips of the screws or bolts at different distances from their respective lugs or brackets but both in engagement with the proximate face of the crossbar 26 of the stationary frame 24. Once the proper angular orientation of the frame 25 relative to the frame 24 has been so achieved, the lock nuts are tightened against their respective lugs or brackets 50 and 51 so as to ensure that the abutment screws or bolts 48 and 49 will be retained in their respective adjusted positions.

For purposes of operator safety and to ensure that an operator's fingers cannot accidentally become caught between the roller 46 and the rigid member 30, a shield 56 is positioned across the entire length of the roller just upstream thereof, the shield for this purpose having a flange **56*a* fixed to the mounting plate 35. Although this can be done in any desired fashion, in the illustrated form of the apparatus the flange 56*a* is interposed between the lugs or brackets 50 and 51 and the proximate edge of the mounting plate 35 and is secured in place by the screws 52 and 53** which also secure the lugs or brackets to the mounting plate.

In order to enable the roller 46 to exert the proper force onto the web W passing between the roller and the rigid member 30 and to ensure that the proper degree of frictional drag will be exerted on the web by the flat upper surface **30*a* of the rigid member 30, biasing means are provided. In the illustrated form of the apparatus, the biasing means comprise a pair of tension springs 57 and 58 anchored at one end to respective adjuncts of the stationary frame 24 and at the other end to the tie rod 39 of the movable frame 25. Merely by way of example, the two springs can be seen to extend from the tie rod 39 through holes or openings 59 and 60 in the crossbar 26 to the projecting opposite end portions of a rigid rod or pin 61 fixedly mounted in the bearing block 31. The springs continuously urge the movable frame 25 to rock about the horizontal pivot axis 45 relative to the stationary frame 24 so as to tend to press the roller 46 with a pre-determined force against the rigid member 30** or against the web W passing thereover.

For the purpose of enabling the leading end of the web W to be initially threaded between the roller 46 and the rigid member 30 for introduction into the nip 16 of the image and pressure cylinders of the printer, the rockable mounting of the movable frame enables the same to be rocked about the horizontal axis 45 against the force of the biasing springs in a sense tending to separate the roller from the rigid member. In order for the operator to be able to do this and maintain the roller in its inactive state while using both hands to properly feed the web into the nip, latching means are provided in the wrinkle-preventing mechanism of the present invention to lock the movable frame 25 temporarily in its roller-retracting position. In the illustrated embodiment of the invention, the latching means includes a hook member 62 which is pivotally supported at one end thereof by the crossbar 26 of the stationary frame for angular movement in a vertical plane. Merely by way of example, the means for so mounting the hook member 62 include a pair of angle brackets 63 having their bases screwed or bolted to the crossbar 26 and their legs projecting away therefrom at a spacing from each other sufficient to accommodate the thickness of the hook member 62, with the latter being connected to a pivot pin 64 supported by the bracket legs. The hook member is preferably a bar having in its underside edge a downwardly open hook-forming recess **62*a* (see FIG. 6), the shape and dimensions of which are such as to enable it to freely receive and accommodate the tie rod 39. The length of the hook member 62 is such that when the frame 25 is in its normal position, with the springs 57 and 58 biasing the roller 46 against the upper surface of the rigid member 30, the underside edge of the hook member rests loosely on the tie rod 39 preferably just inwardly of the location of the recess 62*a***.

It will be understood, therefore, that when the movable frame 25 is shifted about its horizontal rocking axis against the force of the springs 57 and 58 and in a sense tending to separate the roller 46 from the rigid member 30, the tie rod 39 is correspondingly shifted away from the stationary frame 24. As a consequence, at some point during the angular movement of the movable frame 25, the tie rod will come to underlie the recess 62*a* in the hook member 62, permitting the latter to drop down onto and embrace the tie rod and inhibit any further movement thereof and of the frame 25 in either direction. The frame 25 thus is locked in its shifted position, enabling the operator to thread the web W easily over the rigid member and into the nip of the image and pressure cylinders of the printer. When that operation has been completed, the movable frame is released by simply pushing up the projecting nose 62*b* of the hook member 62 in the direction of the arrow B shown in FIG. 4, thereby enabling the frame 25 to rock about the axis 45 in the direction of the arrow C and cause the roller 46 to move in the direction of the arrow D downwardly into pressing engagement with the web extending across the surface 30*a* of the rigid member 30.

In essence, therefore, it will be appreciated that the major elements of the wrinkle-preventing mechanism of the present invention are the elastomer-surfaced, freely rotatable drag-inducing roller 46 which provides loading across the full width of the web, the pressure pad constituted by the stationary flat upper surface 30*a* of the rigid member 30 which provides frictional coupling to the web, and the loading system, i.e., the springs 57, 58 and the load arms or levers 36 and 37 which transfer the spring loads to the roller 46.

It will be understood that the foregoing description of a preferred embodiment of the present invention is for purposes of illustration only, and that the various structural and operational features herein disclosed are susceptible to a number of modifications and changes none of which entails any departure from the spirit and scope of the present invention as defined in the hereto appended claims.

What is claimed is:

1. In combination with a high speed printer utilizing as the printing medium a fanfolded or continuous web and including a rotatable image cylinder and a rotatable pressure cylinder in rolling surface engagement with each other under a high pressure, said image cylinder and said pressure cylinder defining therebetween a nip into which the web is drawn by said cylinders upon rotation thereof, and said image cylinder and said pressure cylinder being skewed relative to each other, with the axis of rotation of said image cylinder being substantially perpendicular to the direction of movement of the web along a path toward said nip, and with the axis of rotation of said pressure cylinder being oriented obliquely to said direction of movement of the web;

a mechanism for preventing wrinkling of the web as it approaches said nip and consequent creasing of the web as it passes through said nip, comprising:

(a) a rigid member extending transversely to said path of movement of the web toward said nip, said rigid member being located upstream of and close to said nip and providing a first surface having appropriate coefficient of friction and wear resistance properties and positioned for contact with one of the surfaces of the web;

(b) a rigid cylindrical roller juxtaposed to said rigid member and providing an elastomeric second surface positioned for contact with the other of the surfaces of the web, the axis of rotation of said roller being oriented obliquely to said direction of movement of the web toward said nip; and (c) biasing means operatively connected with said roller for urging the latter toward said rigid member, so that said second surface of said roller can pressingly engage said other surface of the web when the latter is moving along said path and past said rigid member, thereby to maintain said one surface of the web in contact with said first surface of said rigid member under a force low enough to enable the web to slide over said first surface while frictionally entraining said roller into rotation but high enough to enable said first surface to exert a frictional drag on the web.

2. The combination of claim 1, wherein said axis of rotation of said roller is oriented at an angle of about 2°–5° relative to said direction of movement of the web.

3. The combination of claim 1 or 2, wherein the obliquity of said axis of rotation of said roller relative to said direction of movement generally corresponds to that of said pressure cylinder.

4. The combination of claim 1 or 2, further comprising means for adjusting the angular orientation of said axis of rotation of said roller.

5. The combination of claim 4, wherein said adjusting means is operable to incline said axis of rotation of said roller in one sense or the other relative to said direction of movement of the web.

6. The combination of claim 1, wherein said first surface is metallic and said elastomeric second surface is of polyurethane.

7. The combination of claim 1, wherein the force exerted by said roller on the web under the action of said biasing means is about 8 lbs. for a web having a basis weight in the range of about 15–20 lbs.

8. The combination of claim 1, further comprising normally inactive latching means operable, when activated upon retraction of said roller from said rigid member against the force of said biasing means, to releasably lock said roller in its retracted state so as to maintain a gap between said first and second surfaces for threading of the web therethrough.

9. The combination of claim 1, further comprising first frame means fixedly supporting said rigid member, second frame means rotatably supporting said roller, and a second rigid member extending transversely to said path of movement of the web and supported by said first frame means for pivotal movement about an axis perpendicular to said first surface and said direction of movement of the web, said second rigid member pivotally supporting said second frame means for rocking movement of the latter and said roller therewith about an axis parallel to said axis of rotation of said roller.

10. The combination of claim 9, wherein said biasing means is operatively interconnected between said first and second frame means.

11. The combination of claim 10, further comprising hook means supported by one of said first and second frame means and releasably engageable with an adjunct of the other of said first and second frame means, said hook means being normally disengaged from said adjunct when said roller is pressed under the action of said biasing means against the web passing between said first and second surfaces, and said hook means being adapted to be engaged with said adjunct for releasably locking said second frame means in place when said second frame means is shifted about the rocking axis thereof against the force of said biasing means into a roller-retracting position so as to establish a gap between said first and second surfaces.

12. In combination with a high speed printer of the ion deposition imaging type for printing intelligence on a fanfolded or continuous web being drawn from a source thereof through the printer, which printer includes a rotatable image cylinder, respective means by which ion-generated charges representing said intelligence and appropriate quantities of a toner are applied to and removed from said image cylinder, and a rotatable pressure cylinder in rolling surface engagement with said image cylinder under a high pressure on the order of magnitude of about 1,000 psi or more, said image cylinder and said pressure cylinder defining therebetween a nip into which the web is drawn by said cylinders upon rotation thereof, and said image cylinder and said pressure cylinder being skewed relative to each other, with the axis of rotation of said image cylinder being perpendicular to the direction of movement of the web along a path toward said nip, and with the axis of rotation of said pressure cylinder being oriented obliquely to said direction of movement of the web;

a mechanism for preventing wrinkling of the web as it approaches said nip and consequent creasing of the web as it passes through said nip, comprising:

(a) a first frame straddling said path of movement of the web toward said nip, and a first cross member carried by said first frame and located below said path upstream of and close to said nip and providing an upwardly directed horizontal surface having appropriate coefficient of friction and wear resistance properties and positioned for contact with the lower surface of the web passing thereover;

(b) a second frame straddling said path of movement of the web toward said nip, a cylindrical roller freely rotatably supported at its opposite ends by said second frame for rotation about a first horizontal axis and having an elastomeric exterior peripheral surface in juxtaposition to and above said horizontal surface of said first cross member and said path of movement of the web, and a second cross member pivotally supported by said first frame centrally thereof for angular movement about a vertical axis, said second frame being pivotally supported by said second cross member for rocking movement relative thereto about a second horizontal axis;

(c) biasing means operatively interconnected between said first and second frames for rocking said second frame about said second horizontal axis in a sense tending to cause said roller to be shifted toward and pressed against said horizontal surface of said first cross member, so that said roller can pressingly engage the upper surface of the web when the latter is moving along said path and maintain the lower surface of the web in contact with said horizontal surface of said first cross member under a force low enough to enable the web to slide over said horizontal surface while frictionally entraining said roller into rotation but high enough to enable said horizontal surface to exert a frictional drag on the web;

(d) normally inactive latching means cooperatively carried by said first and second frames, said latching means, when activated upon said second frame being rocked against the force of said biasing means about said second horizontal axis in a sense tending to separate said roller from said horizontal surface of said first cross member, being operable for releasably locking said second frame against movement about said second horizontal axis under the action of said biasing means and thereby maintaining a gap between said roller and said first cross member to enable the web to be threaded therethrough and into said nip; and (e) adjustable abutment means carried by one of said frames and engageable with the other of said frames for disposing said second frame in a preselected angular position about said vertical axis relative to said first frame, thereby to dispose said roller with its axis of rotation in an oblique position relative to the direction of movement of the web toward said nip along said path generally corresponding to the oblique position of the axis of rotation of said pressure cylinder relative to the direction of movement of the web.

13. In combination with a high speed printer of the ion deposition imaging type for printing intelligence on a fan folded or continuous web being drawn from a source thereof through the printer, which printer includes a rotatable image cylinder, respective means by which ion-generated electrostatic charges representing said intelligence and appropriate quantities of a toner are applied to and removed from said image cylinder, and a rotatable pressure cylinder in rolling surface engagement with said image cylinder under a high pressure on the order of magnitude of about 1,000 psi or more, said image cylinder and said pressure cylinder defining therebetween a nip into which the web is drawn by said cylinders upon rotation thereof, and said image cylinder and said pressure cylinder being skewed relative to each other, with the axis of rotation of said image cylinder being perpendicular to the direction of movement of the web along a path toward said nip, and with the axis of rotation of said pressure cylinder being oriented obliquely to said direction of movement of the web;

a mechanism for preventing wrinkling of the web as it approaches said nip and consequent creasing of the web as it passes through said nip, comprising:

(a) a first frame including a first rigid horizontal crossbar fixedly mounted above and transverse to the path of movement of the web toward said nip, and a pair of vertical bars fixedly secured to said first crossbar and depending downwardly therefrom at a spacing from each other disposing them on opposite sides of said path;

(b) a second frame including a pair of rigidly interconnected side arms disposed at a spacing from each other less than that of said vertical bars of said first frame and having upper and lower ends;

(c) a second rigid horizontal crossbar located between and shorter than the spacing of said side arms of said second frame from each other, said second rigid crossbar being pivotally supported at its center by said first rigid crossbar for angular movement relative to the latter about a vertical axis, and said side arms being pivotally supported intermediate their ends by said second rigid crossbar at the opposite ends of the latter for rocking movement of said second frame about a first horizontal axis relative to said first frame;

(d) a third rigid horizontal crossbar affixed to said vertical bars of said first frame and providing a flat upper surface of appropriate coefficient of friction and wear resistance properties located below said lower ends of said side arms of said second frame and below said path of movement of the web toward said nip for contact with the web from below;

(e) a cylindrical roller having an elastomeric exterior peripheral surface, said roller being located between and being freely rotatably supported at its opposite ends by said side arms of said second frame adjacent said lower ends thereof for rotation about a second horizontal axis and so as to dispose said peripheral surface of said roller in juxtaposition to and above said upper surface of said third rigid crossbar and said path of movement of the web for contact with the web from above;

(f) biasing means operatively interconnected between said first and second frames for urging said second frame about said first horizontal axis in a sense tending to press said roller toward said upper surface of said third rigid crossbar so that said roller can engage the web when the latter is moving along said path and press it against said upper surface of said third rigid crossbar under a force low enough to enable the web to slide over said upper surface while entraining said roller into rotation but high enough to enable said upper surface to exert a frictional drag on the web;

(g) normally inactive latching means cooperatively carried by said first and second frames, said latching means, when activated upon said second frame being rocked against the force of said biasing means to separate said roller from said upper surface of said third rigid crossbar, being operable for releasably locking said second frame against movement about said first horizontal axis under the action of said biasing means and thereby maintaining a gap between said roller and said third rigid crossbar to enable the web to be threaded therethrough and into said nip; and (h) individually adjustable abutment means carried by said second rigid crossbar on opposite sides of the location of said vertical axis and engageable with said first rigid crossbar for disposing said second frame in a preselected angular orientation relative to said first frame, thereby to dispose said roller with its axis of rotation in an oblique orientation relative to said third rigid crossbar and to the direction of movement of the web toward said nip along said path generally corresponding to the oblique orientation of the axis of rotation of said pressure cylinder relative to said direction of movement of the web.

14. The combination of claim 13, wherein said second frame includes a transverse tie rod extending between said side arms of said second frame, and said latching means comprises a hook member coplanar with said vertical axis and pivotally supported at one end by said first rigid crossbar, said hook member intermediate its ends having a recess adapted to receive said tie rod therein.

15. The combination of claim 13 or 14, wherein said second frame includes a transverse tie rod extending between said side arms of said second frame, and said biasing means comprises a pair of tension springs located on opposite sides of said vertical axis and each anchored at one end thereof to an adjunct of said first rigid crossbar and at its other end to said tie rod.

* * * * *